US011280486B2

(12) United States Patent
Chen

(10) Patent No.: US 11,280,486 B2
(45) Date of Patent: Mar. 22, 2022

(54) LAMP ELECTRICAL CARD CONNECTION SYSTEM

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 17/342,682

(22) Filed: Jun. 9, 2021

(65) Prior Publication Data

US 2021/0381683 A1 Dec. 9, 2021

Related U.S. Application Data

(60) Provisional application No. 63/036,716, filed on Jun. 9, 2020.

(51) Int. Cl.

| | |
|---|---|
| ***F21V 23/06*** | (2006.01) |
| ***F21V 23/00*** | (2015.01) |
| ***F21Y 103/00*** | (2016.01) |

(52) U.S. Cl.

CPC ..... *F21V 23/06* (2013.01); *F21V 23/002* (2013.01); *F21Y 2103/00* (2013.01)

(58) Field of Classification Search

CPC ..... F21Y 2103/00; F21Y 2103/10; F21V 21/005; F21V 19/004; F21V 23/06; F21V 19/0035

See application file for complete search history.

(56) References Cited

U.S. PATENT DOCUMENTS

| | | | | |
|---|---|---|---|---|
| 4,173,035 A * | 10/1979 | Hoyt | H05B 45/30 362/249.04 |
| 7,703,941 B2 * | 4/2010 | Lee | H05K 1/142 362/219 |
| 7,771,204 B2 * | 8/2010 | Stoyan | F21V 23/06 439/56 |
| 8,262,250 B2 * | 9/2012 | Li | F21V 23/06 362/219 |
| 9,909,743 B2 * | 3/2018 | Dankelmann | F21V 21/005 |

* cited by examiner

*Primary Examiner* — Matthew J. Peerce
(74) *Attorney, Agent, or Firm* — Stuart M. Goldstein

(57) ABSTRACT

An electrical card connection system for an electrical lamp, including a neon lamp which has an upper lamp section and a lower base section, the base section having an end opening leading into a slotted cavity. An electrical circuit card has positive and negative card contacts affixed thereto, each card contact having through slots. An electrical wire carrying a positive charge and an electrical wire carrying a negative charge are connected to a power source. Each wire has an electrical contact member at its terminus. When the electrical contact members at the terminus of each wire are inserted into the slots of the card contacts and the electrical circuit card is inserted into the slotted cavity of the base section, the electricity from the power source is transmitted through the wires into the base section in order to illuminate the lamp.

2 Claims, 4 Drawing Sheets

LAMP ELECTRICAL CARD CONNECTION SYSTEM

RELATED APPLICATION

This application claims the benefit of provisional application Ser. No. 63/036,716, filed on Jun. 9, 2020.

FIELD OF THE INVENTION

The present invention relates to the supply and the connection of electrical power to neon, LED, and like lamps, especially those used in lighting signage.

BACKGROUND OF THE INVENTION

LED, neon, lamps, and similar lighting for signage units and modules normally provide their illumination through the supply of electricity via wiring and wire connections. Most of these individual units require wiring with stripped wire ends and wire connector nuts. Installing these systems is often difficult, inconvenient, and time consuming, especially for large projects. Unfortunately, there are currently very few lamp signage systems which provide the illumination benefits of LED and lamp neon lighting systems, but still allow for the efficient, rapid, and ready installation from power sources and ease of replacement of connections when maintenance is required.

It is thus the object of the present invention to provide an electrical card connection system for lamp signage which can be quickly and easily installed, and which effectively, efficiently, and economically operates to transmit electricity from a power source to the lamp and hence the signage.

SUMMARY OF THE INVENTION

These and other objects are accomplished by the present invention, an electrical card connection system for an electrical lamp, including a neon lamp having an upper lamp section and a lower base section, the base section having an end opening leading into a slotted cavity. An electrical circuit card has positive and negative card contacts affixed thereto, each card contact having through slots. An electrical wire carrying a positive charge and an electrical w re carrying a negative charge are connected to a power source. Each wire has an electrical contact member at its terminus. When the electrical contact members at the terminus of each wire are inserted into the slots of the card contacts and the electrical circuit card is inserted into the slotted cavity of the base section, the electricity from the power source is transmitted through the wires into the base section in order to illuminate the lamp.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
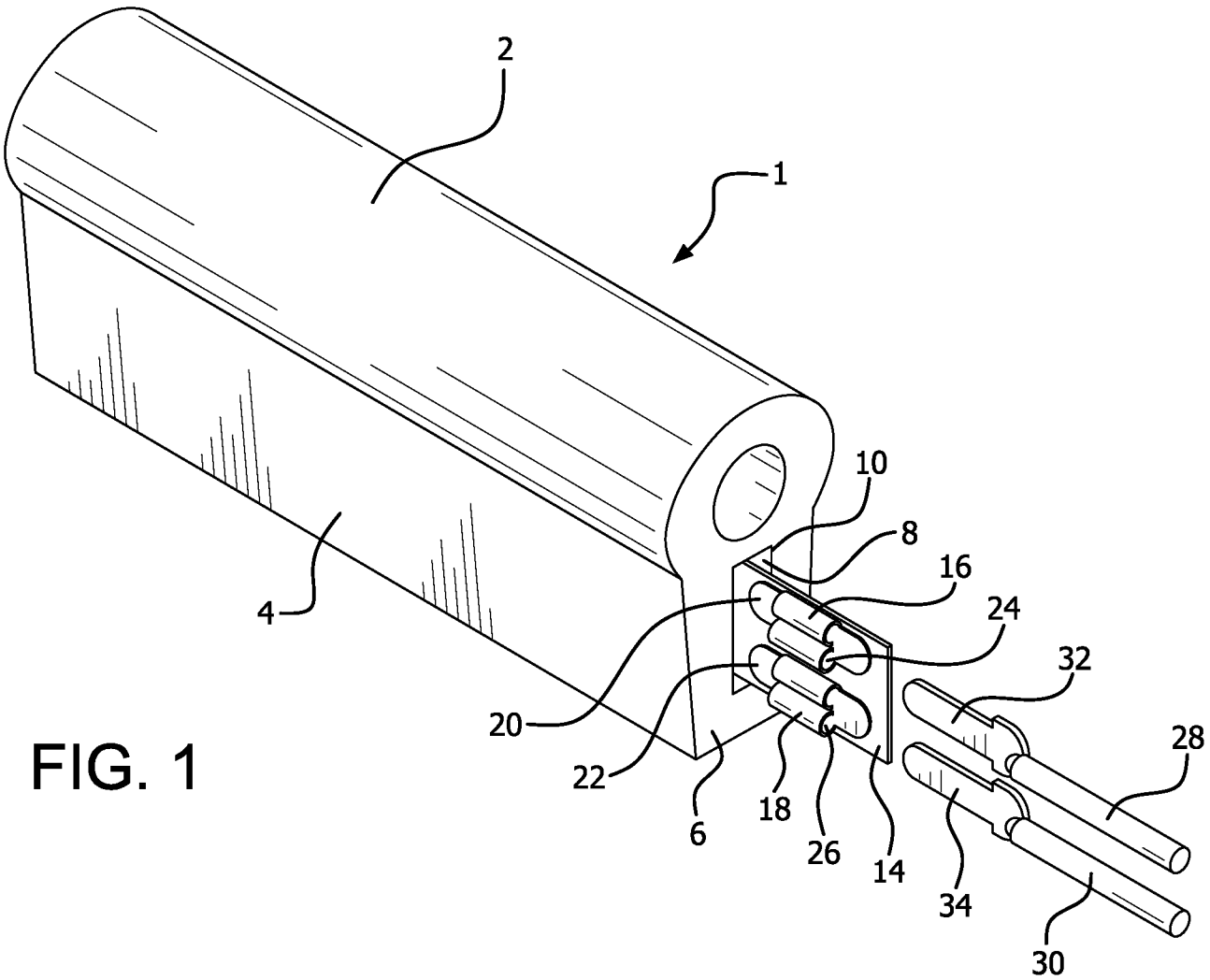
FIG. 1 is an exploded perspective view of the system of the present invention showing the components of the invention, prior to their being inserted into the slotted cavity of the lower lamp base section of the lamp.
Figure 2:
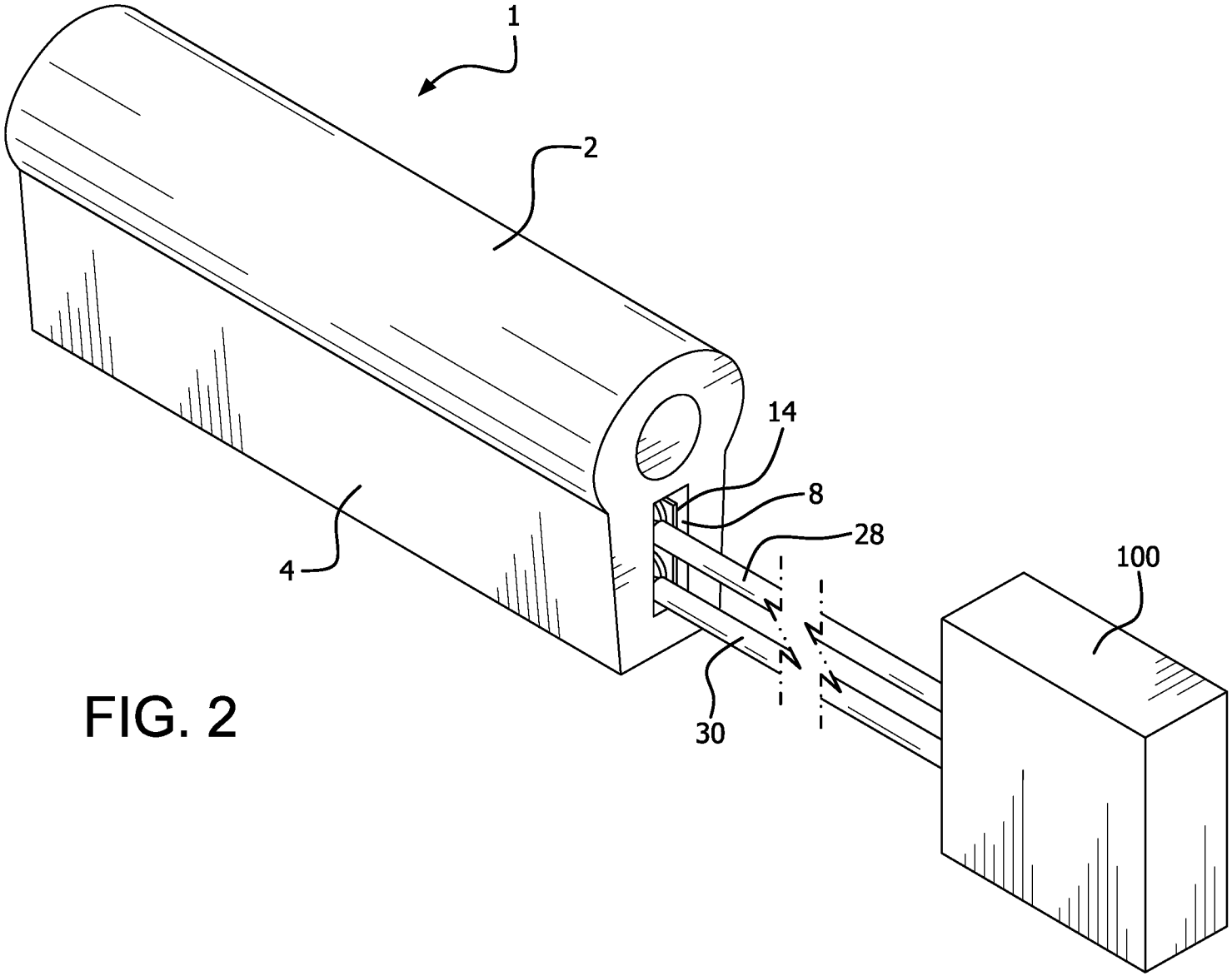
FIG. 2 is a perspective view of the present invention showing the positions of the components of the present invention installed for illumination of the lamp.

The lamp electrical and connection system of the present invention comprises lamp 1 with upper lamp section 2 and lower base section 4. Base section 4 has end 6 with end opening 10 leading into slotted cavity 8. Electrical circuit card 14 has positive card contact 16 and negative card contact 18 affixed thereto by solder 20 and 22 or equivalent means. Card contacts 16 and 18 have through slots 24 and 26. Electrical circuit card 14 is configured to be inserted into slotted cavity 8 containing electrical circuitry which permits the circuit card to transmit electricity to illuminate lamp 1. It is contemplated that lamp 1 can be any variety of electrical lamps, including neon lamps and faux neon lamps.

Electrical wires 28 and 30 receive electricity from power source 100. Wire 28 carries a positive electrical charge from power source 100 and electrical wire 30 carries a negative charge from the power source. Electrical contact members 32 and 34 are located at the terminus of wires 28 and 30. Electrical contact member 32 is configured to be inserted into through slot 24 of card contact 16 and electrical contact member 34 is configured to be inserted into slot 26 of card contact 18.

Figure 3:
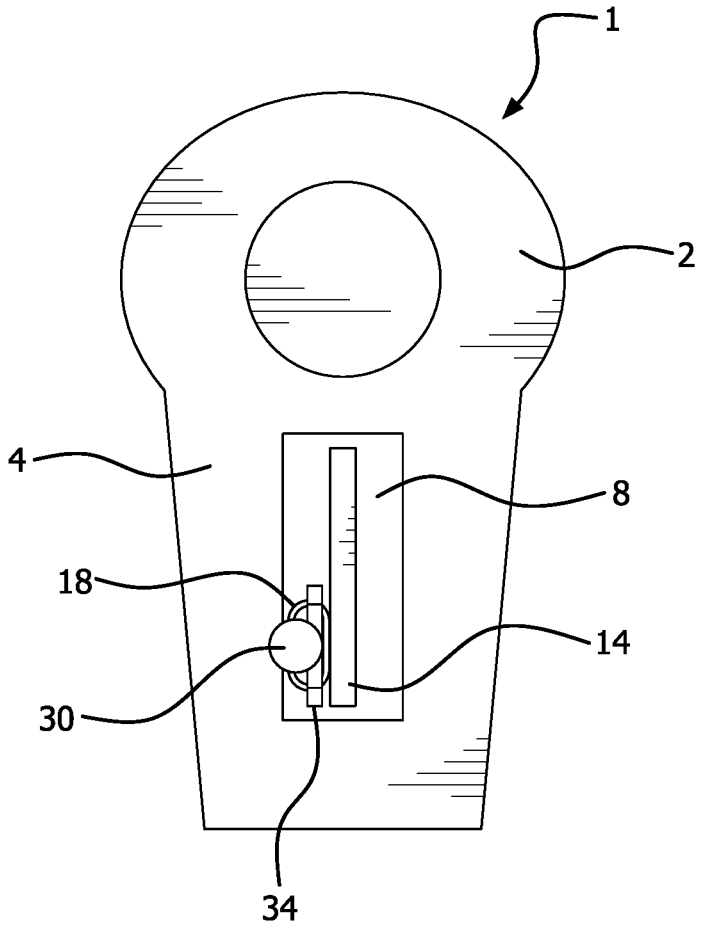
FIG. 3 is an end view showing the inserted positions of the electrical circuit board and one of the electrical wires of the present invention.
Figure 4:
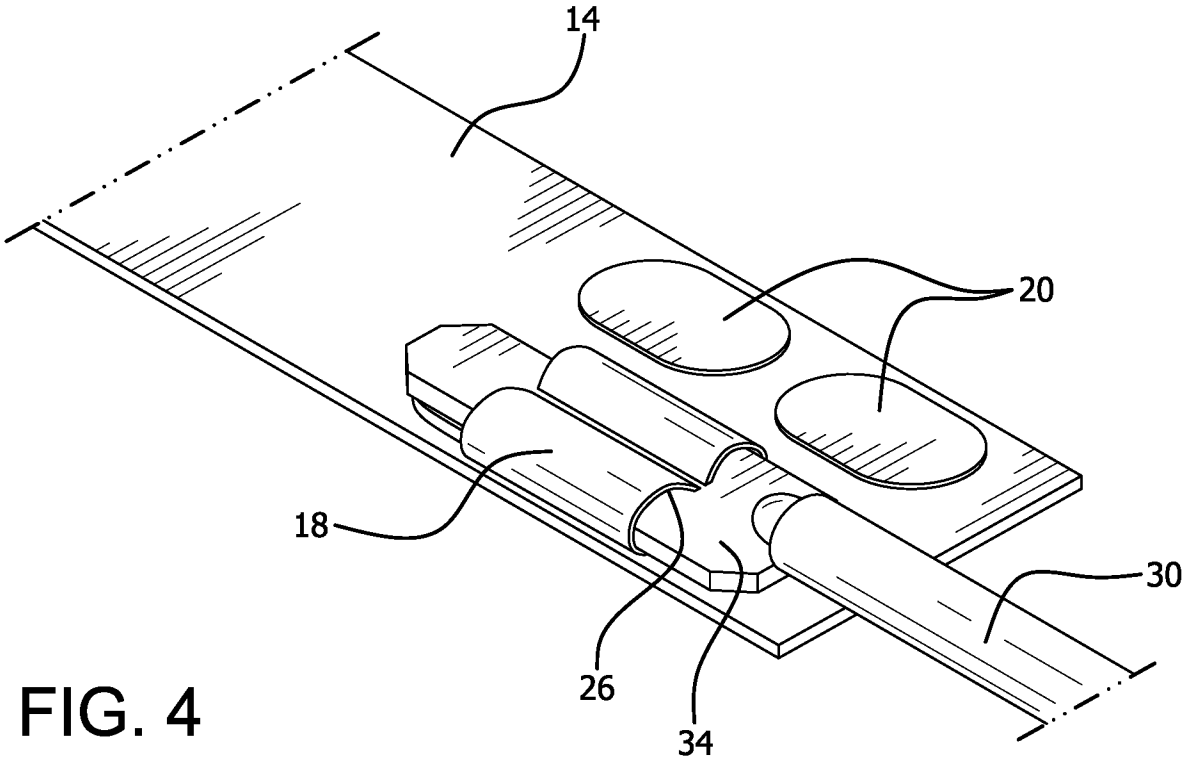
FIG. 4 shows the manner of attachment of the wire contact members to the electrical circuit board of the present invention.

In connecting power source 100 to lamp 1, electrical circuit card 14, with contact members 32 and 34 of wires 28 and 30 positioned in slots 24 and 26 of card contacts 16 and 18, is simply inserted into slotted cavity 8, as seen in FIG. 3. In this manner, electricity from power source 100 is transmitted through wires 28 and 30 and card contacts 16 and 18 on electrical circuit card 14 to lamp base 4 in order to illuminate lamp 1.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A lamp electrical card connection system comprising:

a lamp with an upper lamp section and a lower base section, said base section having an end and an opening at the end leading into a cavity which is completely enclosed within and circumscribed by the base section;

a separable, stand-alone electrical circuit card independent from the lamp, said electrical circuit card having a positive card contact and a negative card contact affixed directly to an outer surface of the electrical circuit card, each of the electric card contacts on said outer surface having a slot which extends over the outer surface, wherein the electric circuit card is configured to be inserted into the cavity; and a first electrical wire carrying a positive charge from an electrical power source and having an electrical contact member located at its terminus and a second electrical wire carrying a negative charge from said electrical power source and having an electrical contact member located at its terminus, the electrical contact member on the first electrical wire being configured to be inserted into the slot of the positively charged card contact on the circuit card and the electrical contact member on the second electrical wire being configured to be inserted into the slot of the negatively charged card contact on the circuit card, whereby when the circuit card is inserted into the cavity and the positive and negative electrical contact members are inserted into their respective card contacts, the electricity from the power source illuminates the lamp.

2. The system as in claim 1 wherein the card contacts are affixed to the circuit card by solder.

* * * * *